US010661596B1

(12) United States Patent
Lindsay

(10) Patent No.: US 10,661,596 B1
(45) Date of Patent: May 26, 2020

(54) ENGRAVERS

(71) Applicant: Steven James Lindsay, Kearney, NE (US)

(72) Inventor: Steven James Lindsay, Kearney, NE (US)

( * ) Notice: Subject to any disclaimer, the term of this patent is extended or adjusted under 35 U.S.C. 154(b) by 168 days.

(21) Appl. No.: 15/413,670

(22) Filed: Jan. 24, 2017

(51) Int. Cl.
*B44B 5/00* (2006.01)
*B25D 17/08* (2006.01)

(52) U.S. Cl.
CPC ..... *B44B 5/0033* (2013.01); *B25D 17/08* (2013.01); *B44B 5/0061* (2013.01)

(58) Field of Classification Search
CPC ..... B44B 5/00; B44B 5/0033; B44B 5/0061; B25D 17/005; B25D 17/08; B25D 3/00; B25D 9/02
See application file for complete search history.

(56) References Cited

U.S. PATENT DOCUMENTS 52,769 A 2/1866 Stockton
174,136 A 2/1876 Howard
399,641 A 3/1889 Wundes
429,223 A 3/1890 Wundes
429,280 A 6/1890 Mills
498,247 A 5/1893 Eaton
719,106 A 1/1903 Gerland
737,761 A * 9/1903 Muller ..... B25D 3/00 30/167
951,535 A 3/1910 Koch
985,934 A 3/1911 Probst
989,794 A 4/1911 Mueller
996,195 A 6/1911 Bahni
1,042,738 A 10/1912 Wilson
2,010,590 A 8/1935 Grumbacher
2,470,385 A * 5/1949 Wenger ..... B25D 17/08 173/169
2,634,775 A * 4/1953 Unsinger ..... B25D 3/00 279/42
2,955,832 A * 10/1960 Gary ..... B23B 51/123 279/103
3,392,792 A * 7/1968 Hunter ..... B21D 7/06 173/102
3,393,755 A 7/1968 Glaser et al.
3,563,559 A * 2/1971 Taylor ..... B25D 17/08 279/19
3,789,704 A * 2/1974 Noestheden ..... B05C 17/10 30/355
3,885,634 A * 5/1975 Goppen ..... B25D 17/08 173/104
3,945,653 A * 3/1976 Falchle ..... B23B 31/005 279/97
4,133,394 A * 1/1979 Wohlwend ..... B25D 17/08 173/210
4,166,507 A * 9/1979 Bouyoucos ..... B25D 9/12 173/105
4,299,293 A * 11/1981 Nikolaev ..... B25D 17/08 173/104
4,416,338 A * 11/1983 Nelson ..... B25D 9/16 173/169

(Continued)

*Primary Examiner* — Christopher R Harmon

(57) ABSTRACT

More specifically, the invention relates to providing hand held engravers that can hold a graver closer to parallel to the work while at the same time raising the handle away from the work. The invention is also reversible allowing a graver to be held at a steep angle to the work.

18 Claims, 7 Drawing Sheets

(56) References Cited

U.S. PATENT DOCUMENTS

| | | | | | |
|---|---|---|---|---|---|
| 4,625,812 | A * | 12/1986 | Pool | B25D 9/00 | 173/128 |
| 4,626,034 | A * | 12/1986 | Breuer | E21C 35/19 | 299/108 |
| 4,694,912 | A | 9/1987 | Glaser | | |
| 4,903,784 | A | 2/1990 | Glaser | | |
| 5,203,417 | A | 4/1993 | Glaser | | |
| 5,515,930 | A | 5/1996 | Glaser | | |
| 6,021,574 | A * | 2/2000 | Murray, III | B41C 1/02 | 30/164.9 |
| 6,095,256 | A | 8/2000 | Lindsay | | |
| 6,488,102 | B2 * | 12/2002 | Lindsay | B44B 3/005 | 173/115 |
| 6,508,315 | B1 | 1/2003 | Lindsay | | |
| 6,530,435 | B1 | 3/2003 | Lindsay | | |
| 6,615,497 | B1 * | 9/2003 | Saunders | B27G 17/02 | 30/487 |
| 6,691,798 | B1 | 2/2004 | Lindsay | | |
| 7,117,602 | B2 * | 10/2006 | Saunders | B27G 17/02 | 30/489 |
| 7,762,347 | B2 | 7/2010 | Glaser et al. | | |
| 7,775,295 | B1 | 8/2010 | Glaser et al. | | |
| 8,176,996 | B2 | 5/2012 | Glaser et al. | | |
| 8,550,179 | B2 | 10/2013 | Glaser et al. | | |
| 9,079,286 | B1 * | 7/2015 | DeCamillis | B25D 9/14 | |
| 2009/0295104 | A1 | 12/2009 | Cover | | |
| 2017/0072551 | A1 * | 3/2017 | Moore | B25D 17/08 | |
| 2017/0275895 | A1 * | 9/2017 | Jacober | E04F 21/22 | |

* cited by examiner

ENGRAVERS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT

Not Applicable.

DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Field of Invention

The present invention relates to hand held engravers, more particularly, angled tool tips for hand held engravers.

Description of Related Art

The traditional hand engraving tool which has been used for banknote and deeper engraving has been in existence for centuries. It consists of a graver (also known as a tool point, tool tip or graver) inset into a mushroom shaped handle that is made to fit into the palm of the human hand. The engraving artist pushes the tool tip through the metal. Ideally for this manual engraver, the lower and closer to parallel the graver shank can be held to the work, the better. A help to manual push engraving of the past was the use of a bent graver shank. A bent graver shank allowed the front portion of the graver shank to be held close to parallel to the surface and yet allowed for the handle to be up and away from the surface which provided clearance for the operator's hand. For example, bent graver shanks are depicted in U.S. Pat. No. 2,010,590 to Grumbacher and U.S. Pat. No. 1,042,738 to Wilson.

U.S. Pat. No. 174,136 to Howaed, discloses a manual push (non powered) engraver that can hold a graver at multiple angles by the use of a circular front end with multiple holes. However, the circular holder is bulky and larger than the body diameter of the engraver. The large end defeats any benefit of allowing the shank of the manual push graver to be used low or close to parallel to the surface of the object being engraved.

Inexpensive wood push graver handles have been readily available for over a century. The user drills a hole in the front of it and pushes a carbon steel bent or straight graver shank in. In more recent times, carbide has been utilized for gravers rather than carbon steel gravers. Unfortunately, carbide shanks cannot be bent as steel can be. There is need for a method to utilize straight graver shanks in manual push engravers as well as modern powered engravers and to provide the benefit of the bent gravers of the past.

Also, in more recent times pneumatic power impact hand engravers have come in to existence, such as U.S. Pat. Nos. 6,095,256, 6,488,102, 6,508,315, 6,530,435, and 6,691,798, all in the name of Steven Lindsay, U.S. Pat. No. 3,393,755 to Glaser et al, U.S. Pat. Nos. 5,515,930, 5,203,417, 4,694,912, 4,903,784 all to Glaser, and U.S. Pat. No. 9,079,286 to DeCamillis, which are used for engraving, carving, and stone setting operations by jewelers and metal artists. These hand held power gravers, as well as the manual non-power tools hold a graver shank in parallel line with the body of the hand held tool. U.S. Pat. No. 5,203,417 to Glaser, and U.S. Pat. No. 9,079,286 to DeCamillis disclose a removable graver holder nose insert that is utilized in powered engravers and that can also be utilized in manual engravers. These removable inserts hold a graver shank in axial alignment with the center axis of the body of the tool. It would be an improvement if an insert graver holder could hold a graver shank at an angle to the body of the tool and thereby give the benefit of what the bent graver shanks of the past provided. It would also be a unique improvement if removable nose inserts can be reversible and allow the user of the tool to rotate the insert 180 degrees so that a graver shank can be held at an angle steep to the work.

There is a need for powered and manual push engraving tools that can hold a graver shank at an angle from the center line of the tool's body, and allow the straight graver shank to be used closer to parallel to the surface being engraved. This will provide the benefit of the past bent steel graver shanks, as well as giving raised clearance for the operator's hand on the handle, more so than a graver shank that is in parallel line with the body center axis. There is also a need for the opposite, that is, to have the graver shank held to a steep angle to the surface being engraved, for various work operations by the artist.

BRIEF SUMMARY OF THE INVENTION

It is the object of this invention to provide hand held engraving tools (both manual and powered) that can hold a graver shank at an angle to the center line of the tool so that straight graver shanks can be utilized to allow the operator the benefit of the steel bent graver shanks of old. By combining the angle with a length of linear body, clearance is made between the operator's hand and object being engraved. This also provides an additional benefit of the steel bent gravers by allowing the graver shank to be closer to parallel to the surface that is being engraved.

Another object of this invention is for the same angled benefit just described to be made with removable nose inserts for manual as well as powered engravers. In powered engravers or with the use of nose inserts there is usually less room to allow the graver to be as low to parallel compared to manual operated engravers or those without nose inserts. However, even in these powered engravers the second benefit of the invention is still realized by having the handle raised up higher from the surface being engraved which makes it easier for the engraving artist to use.

It is also the object of this invention for the hand held engraving tool to be reversible by allowing the graver shank and thus the point to be held comfortably a steeper angle to the surface of the work. This steeper angle is useful depending on the type of work the operator wishes to carry out.

BRIEF DESCRIPTION OF THE SEVERAL VIEWS OF THE DRAWINGS

FIG. 6 represents a cross section of a powered engraver embodiment. Two elements, bore 34 and piston 32 in FIG. 6 are used to illustrate the powered engraver;

FIG. 7 illustrates how the tool can be flipped over and configured by the operator so that graver 17 can be utilized at a steep angle to the work;

FIG. 8 illustrates how the tool can be flipped over and configured by the operator so that the graver 29 can be utilized at a steep angle to the work;

DETAILED DESCRIPTION OF THE INVENTION

Figure 1:
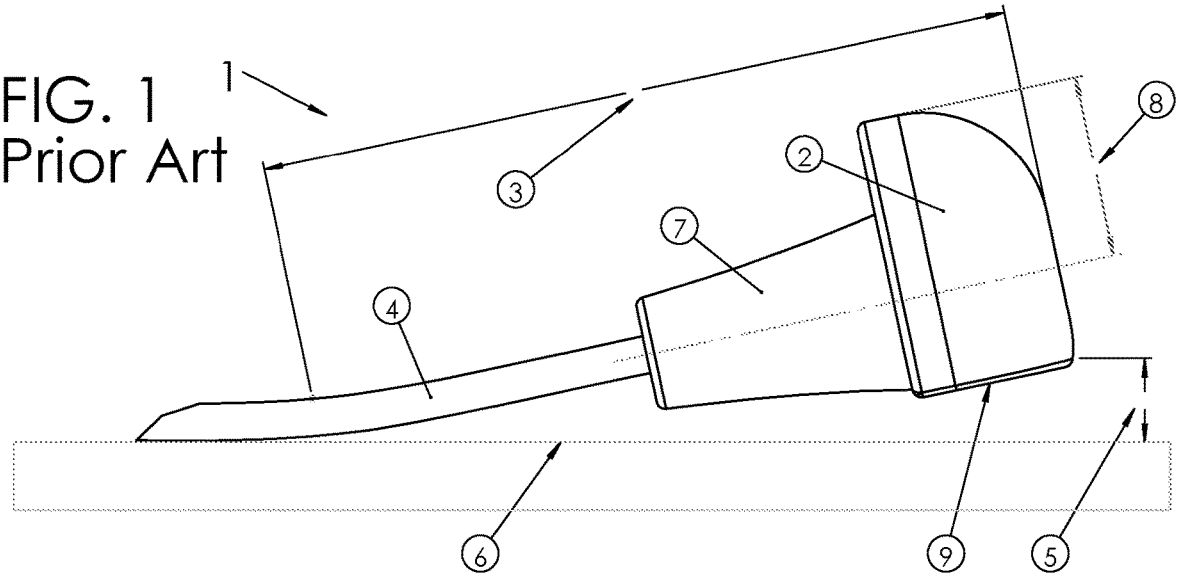
FIG. 1 Prior Art
FIG. 1 is a side view of a prior art manual push graver illustrated with a bent graver shank.

A prior art hand engraver 1 is illustrated in FIG. 1 that has a bent carbon steel graver installed as described in the BACKGROUND OF THE INVENTION section of this document. This prior art manual push engraver consists of handle 2, body 7 and a bent graver 4. Handle 2 and body 7 are a round shape with a center axis 10. Handle flat 9 is a flat portion of the handle 2 that has been removed. Object 6 represents the object being engraved. Handle size 8 is the measurement of both the center axis of body 7 and handle 8 to the top of handle 2. Length 3 is from the back of the handle to the bend in the graver shank Length 3 is important in that it gives a benefit of raising handle 2 off the object 6 a lift distance 5 when the point of the graver 4 is held parallel to the surface of the object 6. Handle lift distance 5 is beneficial to the user so that his or her hand does not need to be as low. The bend in the graver can happen closer to where the shank exits the front of the body 7 (these types of bent graver have been available for over the last century), however there is less benefit because the handle will not be raised as much as when bent further from the front of the body as illustrated in FIG. 1. In other words, the further the distance of length 3 the higher the handle lift distance 5.

Figure 2:
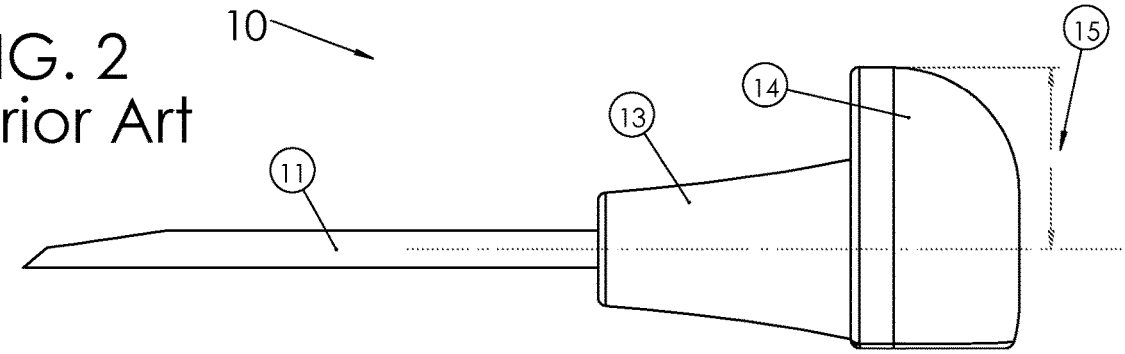
FIG. 2 Prior Art
FIG. 2 is a side view of a prior art manual push graver illustrated with a straight graver shank.

A second prior art engraver 10 is illustrated in FIG. 2 that has a graver 11 installed that has a straight shank. Handle 14 and body 13 are similar to handle 2 and body 7 in FIG. 1. Comparing FIG. 1 with FIG. 2 it can been see that the bent graver in FIG. 1 in effect raises the handle up from the surface of the object 6 in comparison to the engraver with the straight graver shank in the body 13 illustrated in FIG. 2. Having the handle higher makes it easier for jewelers and metal artists to use. Distance 5 in FIG. 1 is apparent, whereas the engraver in FIG. 2 does not have this distance. The factor that provides the benefit is a larger ratio between length 3 and handle size 8 in FIG. 1.

Figure 3:
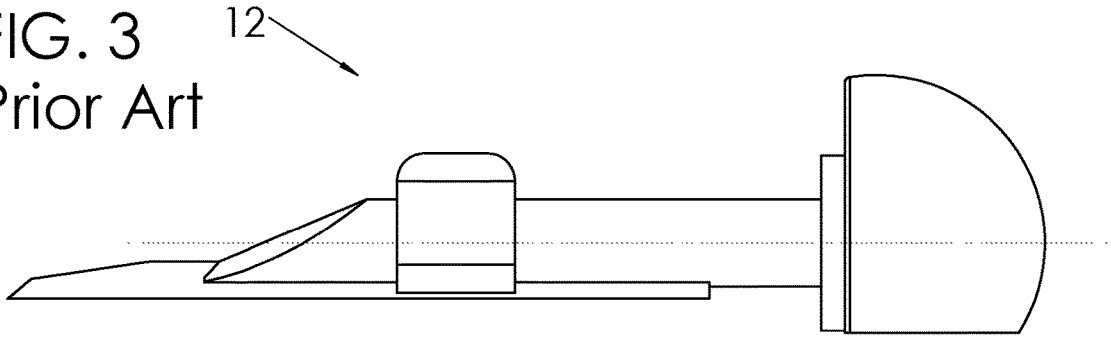
FIG. 3 Prior Art
FIG. 3 is a side view of a prior art manual push graver illustrated with a straight graver shank.

FIG. 3 is a side view of a prior art manual push engraver 12. This unique prior art push graver was designed by master engraver Robert Swartley. As seen in Mr. Swartley's design, engravers and metal artists desire to lower the graver shank as close to parallel to the work as possible while using the modern day straight shanked gravers. This prior art design still holds the graver shank parallel to the center axis of the body, but low and off center, and on the bottom of the body. While this is an improvement over the prior art push graver 10 illustrated in FIG. 2 it still does not give the clearance that bent gravers of old were providing illustrated in FIG. 1.

Figure 4:
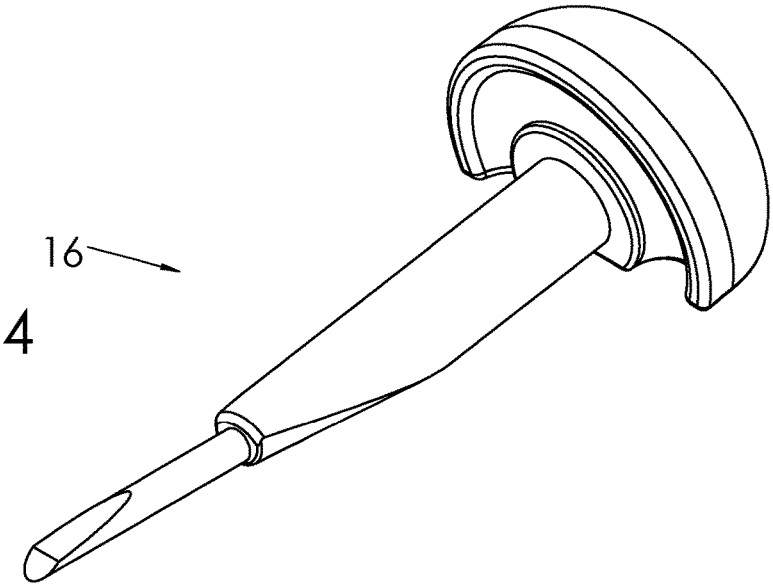
FIG. 4 is a isometric view of an improved engraver (embodiment one) in accordance with the present invention. This embodiment is a manual (non-powered) engraver.
Figure 5:
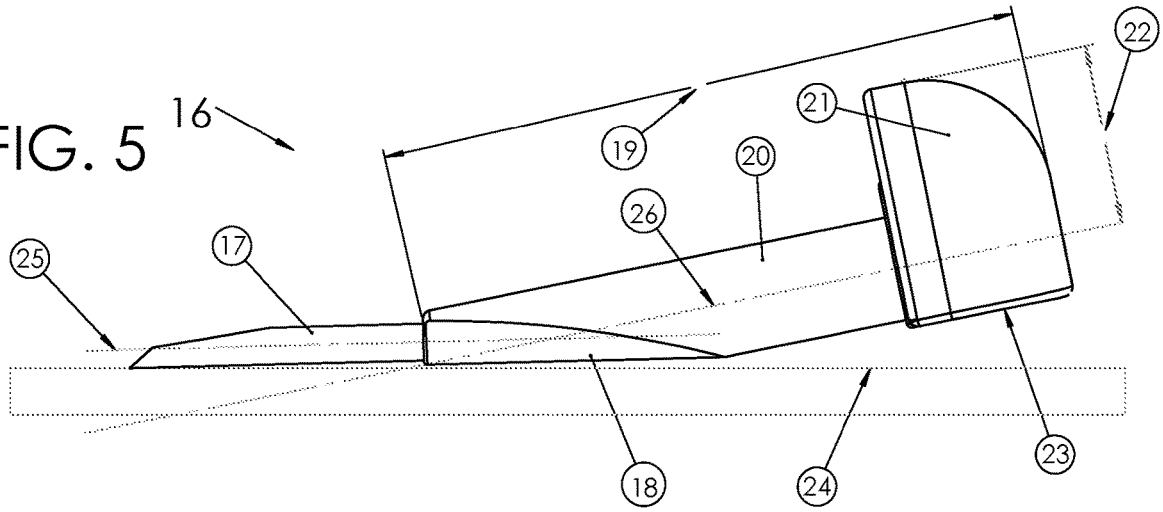
FIG. 5 is a side view of the same improved engraver depicted in FIG. 4, in accordance with the present invention.

FIG. 4 and FIG. 5 are views of an improved hand engraver 16 (embodiment one) in accordance with the present invention. This is a manual push engraver that consists of a body 20, a handle 21 sharing a longitudinal center 26, and a graver 17 having a straight shank that is situated at the opposite end of the body 20 from the handle 21. Handle flat 23 is a flat portion of the handle 21. There is a graver holding hole in body 20 for receiving the shank of graver 17. The graver holding hole has a center axis that is shared with graver shank center axis 25. Graver shank center axis 25 and longitudinal center 26 are at an angle to each other. Front body clearance 18 is a portion of the body that has been removed at or close to parallel to graver shank center axis 25. Object 24 represents the surface of the object that is being engraved. The reader can see the handle height benefit obtained with this (embodiment one) configuration engraver. The configuration is providing handle height similar to the way bent graver shanks of old provided (as the bent graver shank engraver illustrated in prior art FIG. 1). Having the handle higher makes it easier for jewelers and metal artists to use. The factor that provides the higher handle benefit is a ratio between length 19 and handle size 22 in FIG. 5. Applicant has found that a ratio of 2.5 to 1 or greater provides the benefit.

Figure 6:
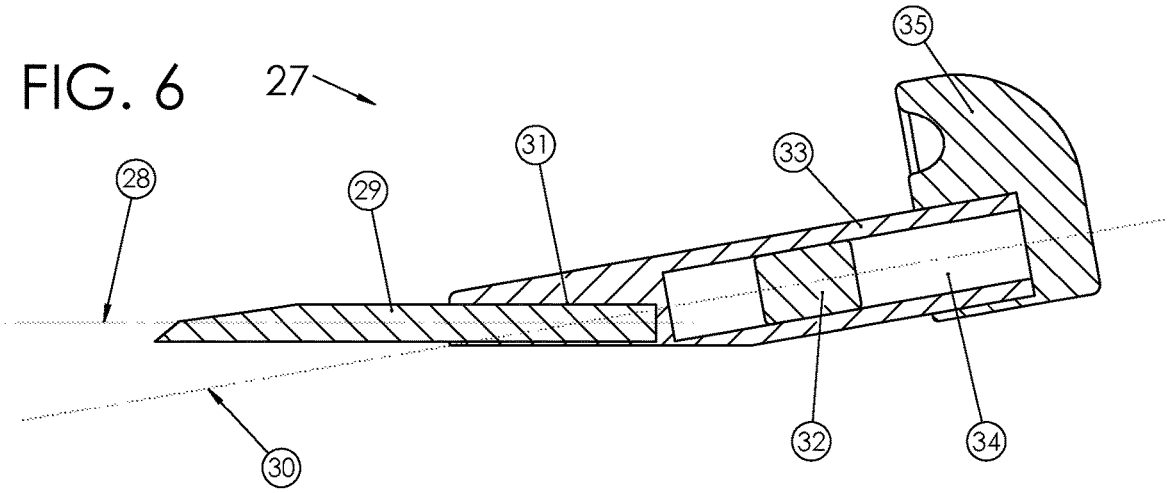
FIG. 6 is a sectional view of an improved engraver (embodiment two) in accordance with the present invention. The present invention can be utilized both in manual, non-powered engravers, as well as in powered engravers.

FIG. 6 is a sectional view of the second and preferred embodiment improved engraver 27 (embodiment two) in accordance to the present invention. This embodiment is a powered engraver that is illustrated with a similar outer construction of engraver 16 in FIG. 4 and FIG. 5 and therefore retains the benefit of the invention of being able to hold a straight shank graver and have the handle raised as described previously, however engraver 27 in FIG. 6. is powered. Engraver 27 in FIG. 6 consists of body 33 with a longitudinal center 30, a handle 35, a graver holding recess 31, with a graver holder recess central axis 28, and a graver 29. This powered engraver also includes bore 34 and piston 32 that are present and essential in prior art pneumatic powered type hand engravers. Bore 32 is within body 33. Bore 34 is a size to accommodate piston 32 with a sliding fit. During operation, the tool is pneumatically powered to bias piston 32 within the bore 34 back and forth, and in and out of contact with an impact location within the bore 34. The impact energy of piston 32 is transferred through to the graver 29 and is utilized for work energy by the user of the tool. The pneumatic oscillation means of piston 32 is not a factor to the the present invention and therefore is not detailed in this document. Piston 32 and bore 34 in FIG. 6 are to represent all oscillation methods of pneumatic hand engravers.

Figure 7:
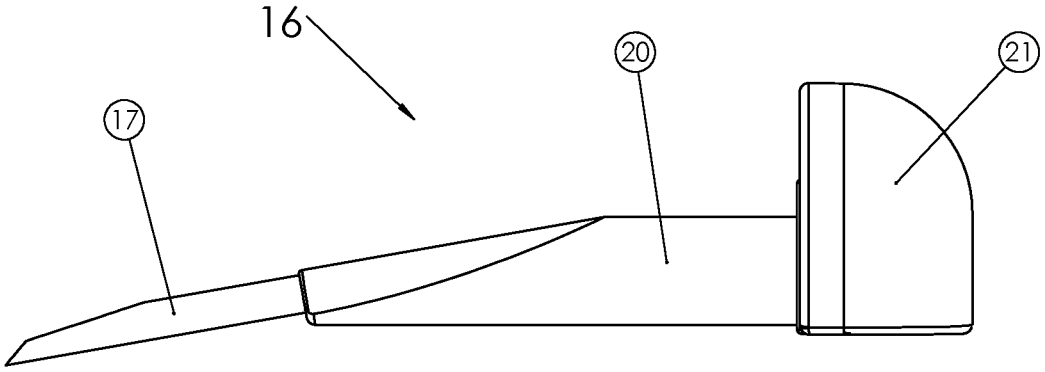
FIG. 7 is a side view of the same improved engraver (embodiment one), as depicted in FIG. 4 and FIG. 5, however.

FIG. 7 is a side view of the same improved engraver 16 (embodiment one) as depicted in FIG. 4 and FIG. 5. However, FIG. 7 illustrates how the tool can be flipped over and configured by the user so that graver 17 can be utilized at a steep angle to the work. In order to accomplish this, the user rotates the handle 21 180 degrees on the body 20. He or she then rotates graver 17 180 degrees. The engraver is then ready for use with its graver at a steep angle to the work. One example that this configuration is helpful to metal artists is in bulino style engraving which can consist of dots and/or short dashes. The graver point is poked into the surface of the work at a steep angle and then popped out which results in a dot or short dash on the object being engraved.

Figure 8:
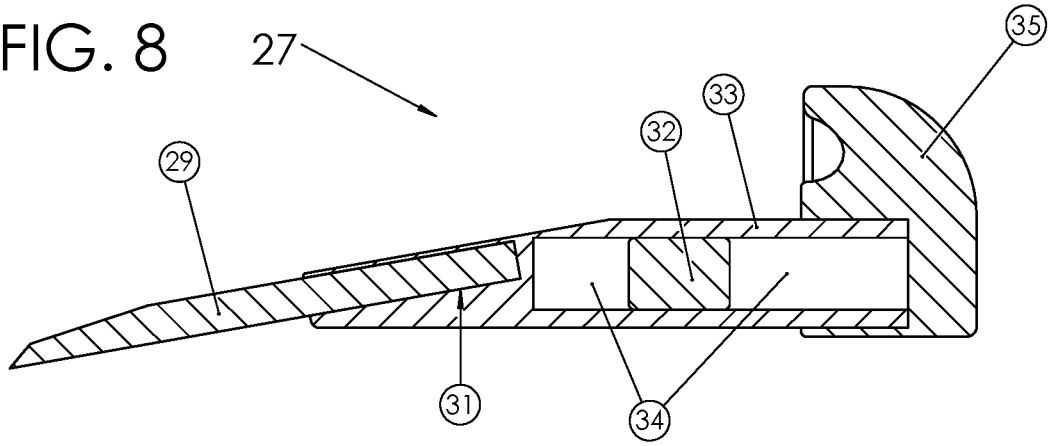
FIG. 8 is a sectional view of the same improved engraver (embodiment two), as depicted in FIG. 6, however

FIG. 8 is a sectional view of the same improved powered engraver 27 (embodiment two), as depicted in FIG. 6. However, FIG. 8 illustrates how the tool can be flipped over and configured by the user so that graver 29 can be utilized at a steep angle to the work. In order to accomplish this, the user rotates the handle 35 180 degrees on the body 33. He or she then rotates graver 29 180 degrees and the engraver is ready for use with its graver at a steep angle to the work.

Figure 9:
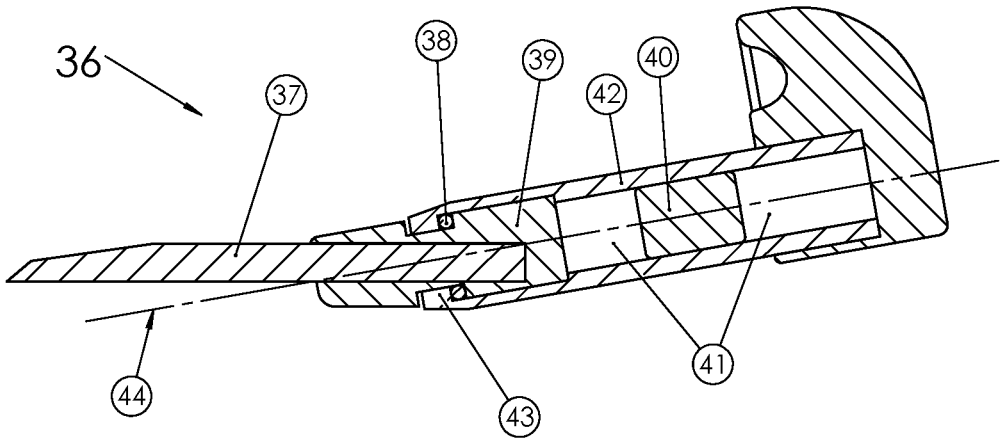
FIG. 9 is sectional view of an improved power engraver (embodiment three), in accordance with the present invention that incorporates a floating graver holder.

FIG. 9 is sectional view of an improved engraver 36 (embodiment three) in accordance to the present invention. The embodiment is similar to embodiment two in FIG. 6 in that both are a pneumatic powered engraver with a bore 41 and piston 40. However engraver 46 incorporates a floating tool holder 39. Floating tool holder 39 has a sliding fit within the bore 41 of body 42. Sandwiched between a groove in the floating tool holder 39 and an annular inside diameter ring 43 of the bore is an o-ring 38. O-ring 38 is made from a resilient rubber type material. Floating tool holder 39 is made to have a sliding fit with bore 41. During operation of the tool, piston 40 oscillates back and forth within bore 41 and collides with the floating tool holder 39. Work energy is transferred through floating tool holder 39 to graver 37 without directly impacting body 42 and thereby lowers the vibration to the user's hand. In accordance to the present invention floating tool holder 39 holds the shank of graver 37 at an angle to the center axis 44 of the body 42. Note: a second o-ring can be utilized for additional resilience on the other side of inside diameter ring 43 at the front of body 42.

Figure 10:
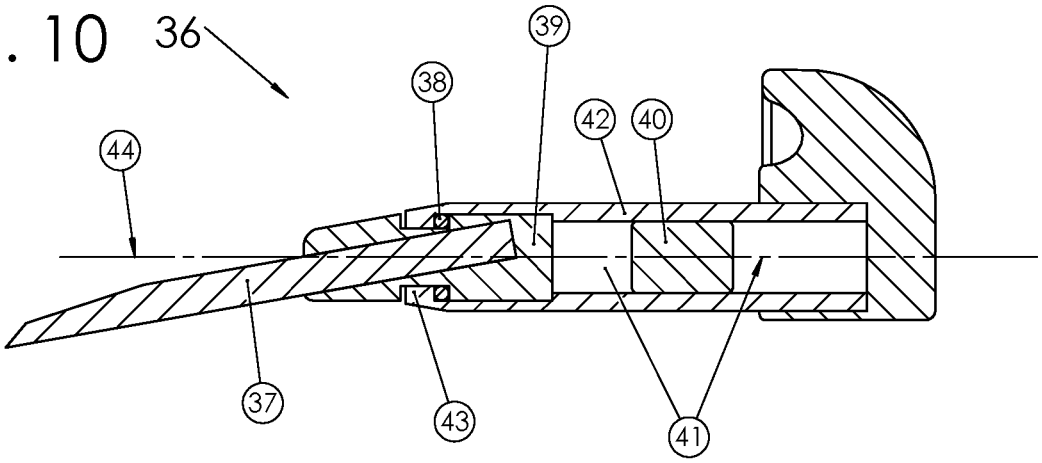
FIG. 10 is sectional view of the same improved engraver as depicted FIG. 9 (embodiment three) differing in that the tool holder nose has been rotated by the user so that the graver 37 can be utilized at a steep angle to the work.

FIG. 10 is sectional view of the same improved engraver 36 as depicted in FIG. 9 (embodiment three) differing in that the floating tool holder 39 has been rotated by the user so that the graver 37 can be utilized at a steep angle to the work.

Figure 11:
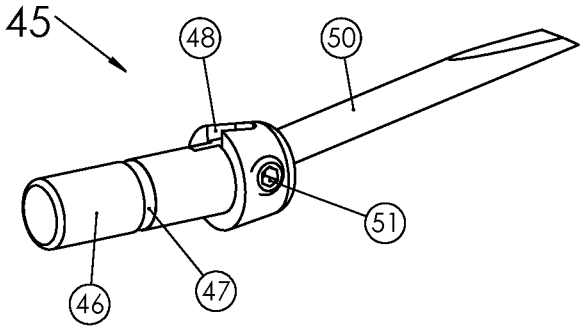
FIG. 11 is an isometric view of single angled holder insert 45 for use in an improved engraver in accordance with the present invention (embodiment four). The angle holder nose insert contains one indexing groove.
Figure 12:
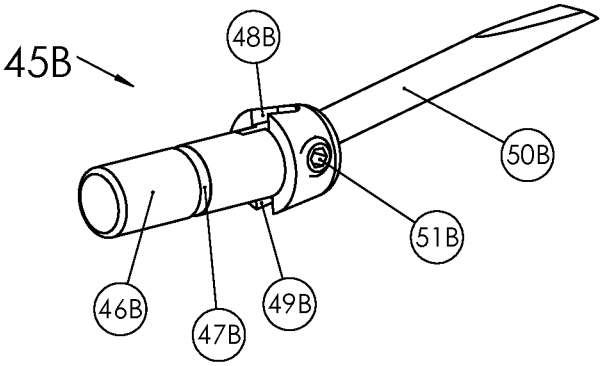
FIG. 12 is an isometric view of a dual angled holder insert 45B for use in an improved engraver in accordance with the present invention (embodiment five). The angle holder nose insert contains two indexing grooves.

FIG. 11 and FIG. 12 are two different holder inserts that are used to hold a graver at an angle from the center axis of the holder inserts themselves. The two holder inserts differ in that single angled holder insert 45 in FIG. 11 has one index groove, groove 48, whereas dual angled holder insert 45B in FIG. 12 has two index grooves: groove 48B and groove 49B. The graver 50 and 50B in the two holder inserts 45 and 45B are locked in place with setscrews 51 and 51B. Except for the additional index groove 49B that dual angled holder insert 45B has and that single angled holder insert 45 does not have, the two holder inserts are the same.

Figure 13:
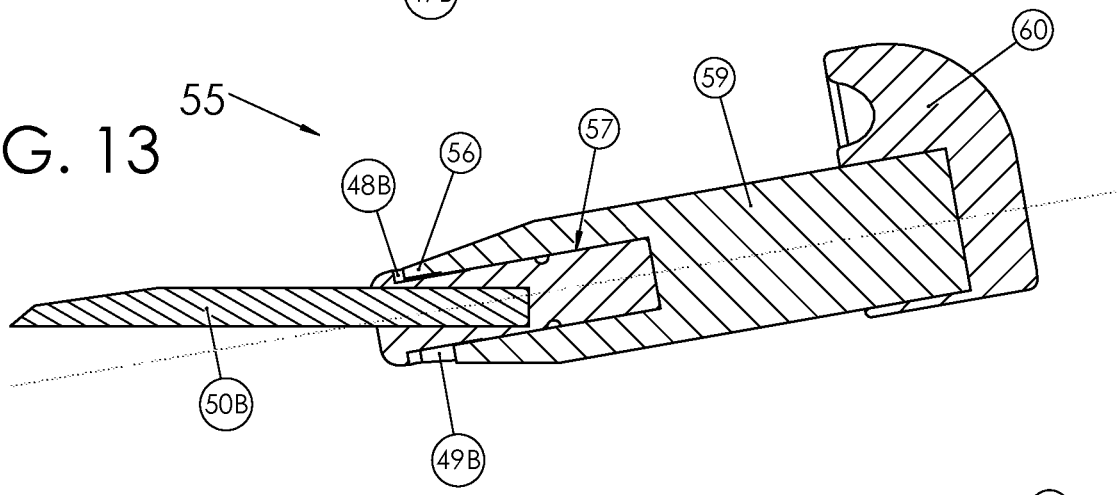
FIG. 13 is sectional view of an improved engraver in accordance with the present invention (embodiment five) that is utilizing the dual angled holder insert 45B illustrated in FIG. 12.
Figure 14:
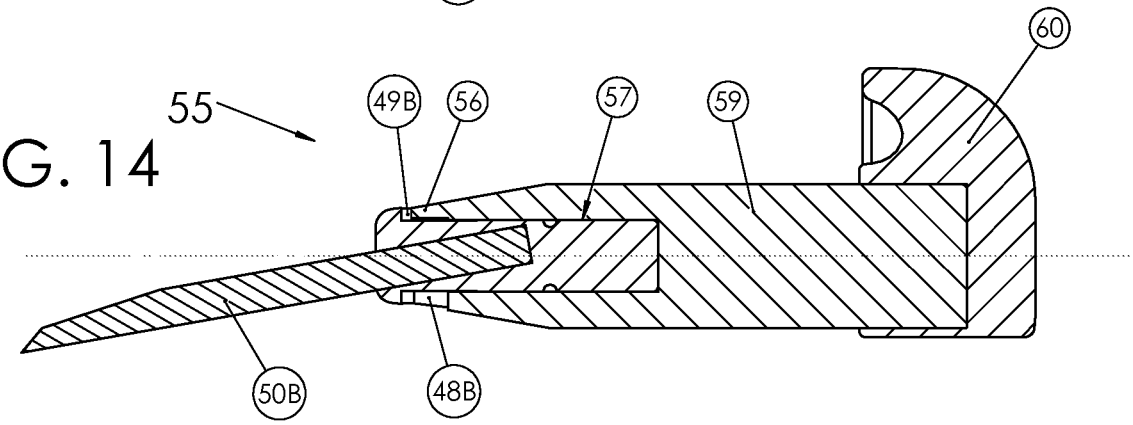
FIG. 14 is sectional view of the same improved engraver as depicted FIG. 13 (embodiment five) that is utilizing the dual angled holder insert 45B illustrated in FIG. 12, however the dual angled holder insert 45B has been rotated by the user 180 degrees compared to FIG. 13.

FIG. 13 and FIG. 14 are sectional views of an improved engraver 55 (embodiment four) in accordance to the present invention that can utilize either of the holder inserts illustrated in FIG. 11 and FIG. 12. FIG. 13 and FIG. 14 depict dual angled holder insert 45B in the engraver. At the front end of body 59 is a hole 57 that is a size for a sliding fit to diameter 46B (FIG. 12) of dual angled holder insert 45B, and to diameter 46 (FIG. 11) of single angled holder insert 45. Referring to FIG. 13 and FIG. 14, on the front end of body 59 is a protruding index tab 56 that is made a size to fit in grooves 48B and 49B of dual angled holder insert 45B (FIG. 12), as well as groove 48 of single angled holder insert 45 (FIG. 11). Dual angled holder insert 45B is removable as well as being reversible from body 59. Groove 47B on dual angled holder insert 45B (FIG. 12), and groove 47 on single angled holder insert 45 (FIG. 11) is for an o-ring to help keep the holder insert in place without falling out of body 59 (FIG. 13 and FIG. 14), yet the o-ring is resilient enough to allow the user to remove or insert it into the hole 57. During use, the operator inserts the dual angled holder insert and aligns up either groove 48B or groove 49B to the index tab 56. FIG. 13 illustrates the invention with index tab 56 aligned with groove 48B, and FIG. 14 illustrates the invention with groove 49B aligned with index tab 56. The single angled holder insert 45 that has one index groove 48 illustrated in FIG. 11 can provide the same results of dual angled holder insert 45B, however instead of rotating the single angled holder insert 180 degrees to a second groove the user rotates the graver 50 180 degrees as well as the handle 60 180 degrees on the body 59.

Figure 15:
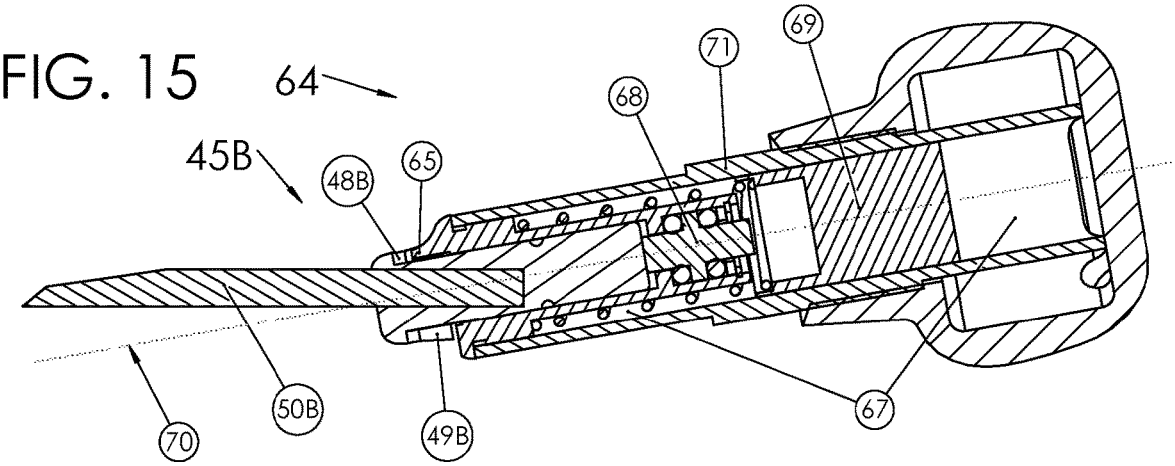
FIG. 15 is sectional view of an improved engraver in accordance with the present invention (embodiment six) that is utilizing the dual angled holder insert 45B illustrated in FIG. 12. This (embodiment six) illustrates how the invention can be utilized in power engravers designs that are half pneumatic and half mechanical spring for oscillating the piston by utilizing the single angled or dual angled holder inserts illustrated in FIG. 11 and FIG. 12.
Figure 16:
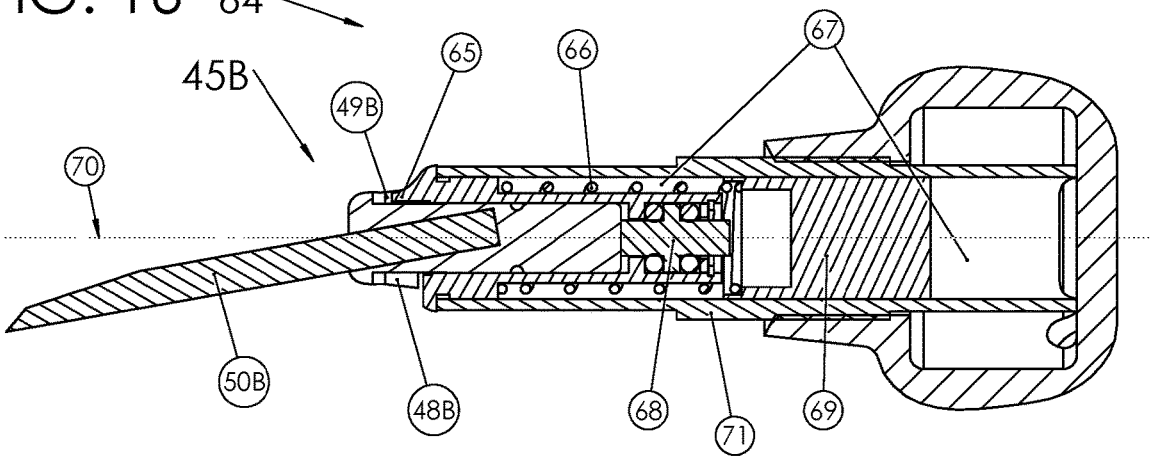
FIG. 16 is sectional view of the same improved engraver in FIG. 15 (embodiment six) that is utilizing the dual angled holder insert 45B illustrated in FIG. 12. The dual angled holder insert 45B has been rotated 180 degrees by the user compared to how it is depicted in FIG. 15.

FIG. 15 and FIG. 16 are sectional views of an improved engraver 64, that by the use of the dual angled holder insert 45B depicted in FIG. 12 is in accordance to the present invention (embodiment five). Similarly as described with embodiment four (illustrated FIG. 13 and FIG. 14), the dual angled holder insert 45B as well as the single angled holder insert 45 can be utilized on powered engravers, both fully pneumatic as well as on partially pneumatic and partially mechanical powered engravers. FIG. 15 and FIG. 16 depict the invention with a power engraver that is partially pneumatic and partially mechanical spring powered. These type of power graver designs utilizes multiple pulses of air (or fluid or gas) from a separate power unit that is delivered through tubing to the handle end of bore 67. The pulse of air pushes piston 69 forward to collide into intermediator pin 68. The work energy is transferred through intermediator pin 68 to dual angled holder insert 45B and finally to graver 50B. The piston is then returned back to the handle direction within the bore by spring 66.

During use, the operator inserts the dual angled holder insert 45B and aligns up either groove 48B or groove 49B with the index tab 65 that is made to a size that fits into the grooves 48B and 49B. FIG. 13 illustrates the invention with index tab 65 aligned with groove 48B. FIG. 14 illustrates the invention with groove 49B aligned with index tab 56. The single angled holder insert 45 that has one index groove 48 illustrated in FIG. 11 can give the same results of dual angled holder insert 45B, by instead of rotating the holder insert 180 degrees to a second groove the user rotates the graver 50 itself within the holder insert 180 degrees. As in previous embodiments of improved engravers in accordance to the present invention, engraver 64 (embodiment five) in FIG. 15 and FIG. 16 enables the graver shank center axis to be held to an angle to the center axis 70 of the body 71 by the use of either holder insert 45 (FIG. 11) or by the use of holder insert 45B (FIG. 12).

Figure 17:
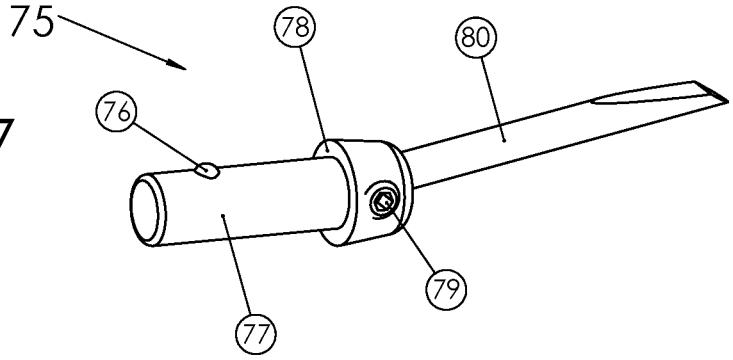
FIG. 17 is an isometric view of a detent angled holder insert 75 for use in an improved engraver in accordance with the present invention (embodiment seven)
Figure 18:
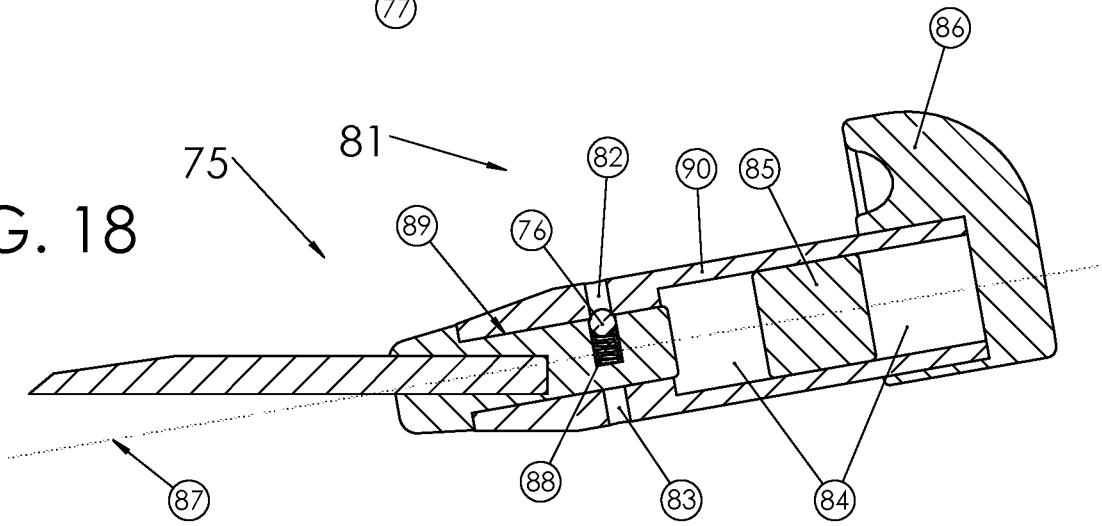
FIG. 18 is sectional view of an improved engraver in accordance with the present invention (embodiment seven) that is utilizing the detent angled holder insert 75 illustrated in FIG. 17.
Figure 19:
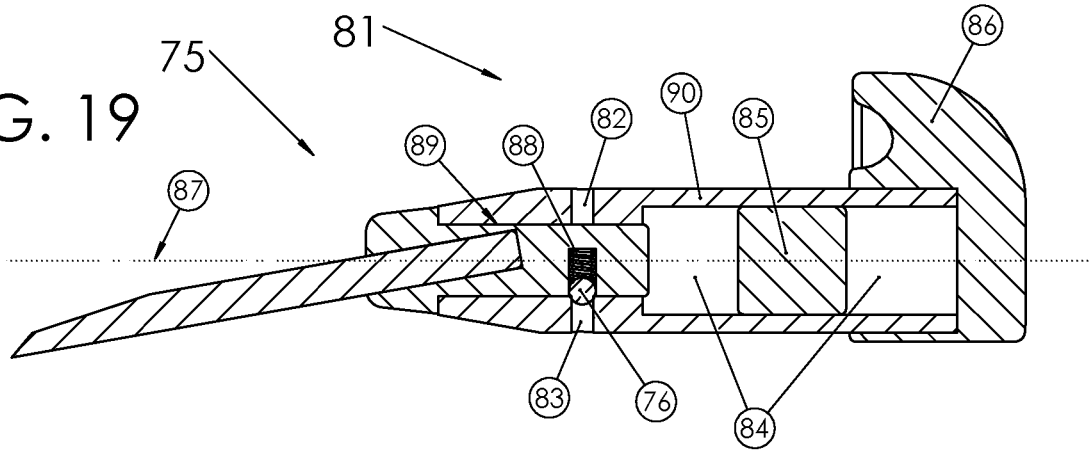
FIG. 19 is sectional view of the same improved engraver as depicted FIG. 18 (embodiment seven) that is utilizing the detent angled holder insert 75 illustrated in FIG. 17, however the detent angled holder insert 75 has been rotated by the user 180 degrees compared to FIG. 18.

In accordance to the present invention, FIG. 17 is a detent angled holder insert 75 (embodiment seven) that is used to hold a graver 80 at an angle from the center axis of the holder insert itself. FIG. 18 and FIG. 19 illustrate a sectional view of the detent angled holder insert 75 installed into engraver 81. Detent angled holder insert 75 has a diameter 77 that is made to a size that is a sliding fit to hole 89 in the front end of body 90. Graver 80 in the detent angled holder insert 75 is locked in place with screw 79. Step 78 on the detent angled holder insert 75 rides against the front end of the body 90 of engraver 81 (FIG. 18 and FIG. 19) when the holder insert is placed into hole 89 by the user. On the side of the diameter of detent angled holder insert 75 is a detent ball 76 and behind it within the diameter 77 is spring 88 that biases detent ball 76 outward. Detent hole 82 and detent hole 83 are for detent ball 76 to snap into when the detent angled holder insert 75 is inserted into hole 89. FIG. 18 illustrates the holder insert in one orientation with ball 76 in hole detent 82, and FIG. 19 illustrates the holder insert rotated 180 degrees, with ball 76 in hole detent 83. Similarly to single angled holder insert 45 in FIG. 11 and dual angled holder insert 45B in FIG. 12 the detent angled holder insert 75 in FIG. 17 holds graver 80 at an angle to the center axis of the insert itself as well as to the engraver's body center axis that it is installed into, and in the case of FIG. 18 and FIG. 19 body center axis 87 that is shared with handle 86 axis. Detent angled holder insert 75 (FIG. 17) can be utilized in manual as well as powered engravers. Engraver 81 in FIG. 18 and FIG. 19 represents a powered engraver by being illustrated with bore 84 and piston 85 that are present and essential in pneumatic powered type hand engravers. Bore 84 is within body 90. Bore 84 is a size to accommodate piston 85 with a sliding fit. During operation, the tool is pneumatically powered to bias piston 85 within the bore 84 back and forth, and in and out of contact with an impact location within the bore 84. The impact energy of piston 84 is transferred through detent angled holder insert 75 to graver 80 and is utilized for work energy by the user of the tool. The pneumatic oscillation means of piston 85 is not a factor to the the present invention and therefore is not detailed in this document. Piston 85 and bore 84 in FIG. 18 and FIG. 19 are to represent all oscillation methods of pneumatic hand engravers. Note: Additional resilience to detent angled holder insert 75 can be utilized with the use of a rubber type o-ring. Referring to FIG. FIG. 17, FIG. 18 and FIG. 19. this o-ring would be placed between step 78 and the front of body 90.

The single angled holder insert 45 illustrated in FIG. 11, the dual angled holder insert 45B illustrated in FIG. 12, and detent angled holder insert 75 illustrated in FIG. 17 can be utilized in all types of hand engravers and in both powered and non-powered engravers without departing from the present invention. For example the angled holder nose inserts can be utilized with engravers such as, but not limited to: U.S. Pat. Nos. 6,488,102, 6,508,315, 6,530,435, 6,691, 798, 6,095,256 all to Lindsay, U.S. Pat. Nos. 4,694,912, 4,903,784, 5,203,417, 5,515,930 all to Glaser, U.S. Pat. Nos. 3,393,755, 7,762,347, 7,775,295, 8,176,996, 8,550,179 all to Glaser et al., and U.S. Pat. No. 9,079,286 to DeCamillis.

CONCLUSION, RAMIFICATIONS, AND SCOPE

Accordingly, the reader will see that the improved hand engravers provide a unique feature for helping engravers, jewelers and metal artists carry out their work. The invention provides improved engravers that can hold a graver shank at an angle to the center line of the tool so that modern day straight tool shanked gravers can be utilized and glean the benefit which the bent graver shanks were providing in the past. The invention helps straight graver shanks to be used closer to parallel to the work surface as well as raising the handle away from the work surface which provides clearance for the user's hand.

In powered engravers or with the use of angled nose inserts there is usually less room to allow the graver to be as low to parallel compared to manual operated engravers or those without nose inserts. Even in these powered engravers however, the second benefit of the invention is still realized by having the handle raised up higher which makes it easier for the engraving artist to use. The invention, with or without nose inserts, also provides the graver to be used at a steep angle to the work.

In accordance with the present invention, the various methods to bias the piston in a power engraver are not critical to the invention. In other words, the present invention can be utilized by many types of power engravers that bias the piston differently. For example the present invention can be utilized with pneumatic power engravers such as, but not limited to: U.S. Pat. Nos. 6,488,102, 6,508,315, 6,530, 435, 6,691,798, 6,095,256 all to Lindsay, U.S. Pat. Nos. 4,694,912, 4,903,784, 5,203,417, 5,515,930 all to Glaser, U.S. Pat. Nos. 3,393,755, 7,762,347, 7,775,295, 8,176,996, 8,550,179 all to Glaser et al., and U.S. Pat. No. 9,079,286 to DeCamillis.

Although the invention has been described with reference to the various embodiments, it should be noted that equivalents may be employed and substitutions made therein without departing from the scope of the invention as recited in the claims. For example: The angle of the graver shank can be at other angles than what are illustrated in the drawings without departing from the present invention. FIG. 10 and FIG. 11 illustrate one way to construct a floating tool holder 39 in an engraver. Other designs of constructing a floating tool holder can be utilized without departing from the present invention. Accordingly, the scope of the invention should be determined not by the embodiments illustrated, but by the appended claims and their legal equivalents.

I claim:

1. A hand held engraver, comprising:

a body having a linear shape, a longitudinal center axis, a first end, and a second end, said body having a mushroom shaped handle located at said second end to fit in the palm of a human hand, said mushroom shaped handle having a mushroom center axis substantially parallel to said longitudinal center axis, a graver having a linear shaped shank with a single point at one end, an angled graver hole having a center axis located at said first end for supporting said graver, said longitudinal center axis and said center axis are at an angle relative to each other, at the location of said angled graver hole said longitudinal center axis continues sustainability straight and does not angle, a removable nose insert at said first end having said angled graver hole within said removable nose insert, said removable nose insert is removable and installable into a recess in said first end of said body, said removable nose insert having a radial outer surface, said radial outer surface is configured to index said removable nose insert within said recess in at least one location, said removable nose insert having a first diameter and a second diameter that is smaller than said first diameter, and when removable nose insert is installed into said recess in said first end of said body said second diameter is disposed inwardly to said body.

2. A hand held engraver, recited in claim 1 further comprising:

at least one groove formed on at least a portion of said radial outer surface running substantially parallel with said longitudinal center axis.

3. A hand held engraver, recited in claim 2 further comprising:

a second groove formed on at least a portion of said radial outer surface running substantially parallel with said longitudinal center axis.

4. A hand held engraver, recited in claim 1 further comprising:

said removable nose insert configured to be resiliently held in said recess.

5. A hand held engraver, recited in claim 4 further comprising:

an annular groove on said second diameter, an o-ring made from a resilient material and received into said annular groove, and said o-ring is deposed within said recess when said removable nose insert is installed into said recess.

6. A hand held engraver, recited in claim 1 further comprising:

a resilient detent on said second diameter; and a detent hole within said recess for receiving said resilient detent.

7. A hand held engraver, recited in claim 1 further comprising:

a bore within said body, a piston disposed within said bore movable longitudinally within said bore, and said piston configured to impact.

8. A hand held engraver, recited in claim 2 further comprising:

a bore within said body, a piston disposed within said bore movable longitudinally within said bore, and said piston configured to impact.

9. A hand held engraver, recited in claim 4 further comprising:

a bore within said body, a piston disposed within said bore movable longitudinally within said bore, and said piston configured to impact.

10. A hand held engraver, recited in claim 5 further comprising:

a bore within said body, a piston disposed within said bore movable longitudinally within said bore, and said piston configured to impact.

11. A hand held engraver, recited in claim 6 further comprising:

a bore within said body, a piston disposed within said bore movable longitudinally within said bore, and said piston configured to impact.

12. A hand held engraver, comprising:

a body having a linear shape, a longitudinal center axis, a first end, and a second end, said body having a mushroom shaped handle located at said second end to fit in the palm of a human hand, said mushroom shaped handle having a mushroom center axis substantially parallel to said longitudinal center axis, a graver having a linear shaped shank with a single point at one end, an angled graver hole having a circular shape with a center axis located at said first end for supporting said graver, said longitudinal center axis and said center axis are at an angle relative to each other, at the location of said angled graver hole said longitudinal center continues sustainability straight, and does not angle, a removable nose insert at said first end having said angled graver hole within said removable nose insert, said removable nose insert is removable and installable into a recess in said first end of said body, said removable nose insert having at least two diameters, a first indexing linear cut formed on at least one of said at least two diameters, said first indexing linear cut running in direction parallel with said longitudinal center axis, and said removable nose insert is configured to index by utilizing said first indexing linear cut.

13. A hand held engraver, recited in claim 12 further comprising:

a second indexing linear cut formed on at least one of said at least two diameters.

14. A hand held engraver, recited in claim 12 further comprising:

said removable nose insert configured to be resiliently held in said recess.

15. A hand held engraver, recited in claim 14 further comprising:

an o-ring made from a resilient material and received into said annular groove, and said o-ring is deposed within said recess when said removable nose insert is installed into said recess.

16. A hand held engraver, recited in claim 12 further comprising:

a bore within said body, a piston disposed within said bore movable longitudinally within said bore, and said piston configured to impact.

17. A hand held engraver, recited in claim 14 further comprising:

a bore within said body, a piston disposed within said bore movable longitudinally within said bore, and said piston configured to impact.

18. A hand held engraver, recited in claim 15 further comprising:

a bore within said body, a piston disposed within said bore movable longitudinally within said bore, and said piston configured to impact.

* * * * *